US005671245A

United States Patent [19]

Nacke et al.

[11] Patent Number: 5,671,245

[45] Date of Patent: Sep. 23, 1997

[54] MAGNETIC YOKE HAVING CARRIER BODY AND INSULATING BODY

[75] Inventors: Bernard Nacke, Lünen; Christoph Aundrup, Dortmund; Manfred Mertens, Selm, all of Germany

[73] Assignee: ABB Patent GmbH, Mannheim, Germany

[21] Appl. No.: 484,521

[22] Filed: Jun. 7, 1995

[30] Foreign Application Priority Data

Jun. 14, 1994 [DE] Germany ..... 9409470 U

[51] Int. Cl.[6] ..... H05B 6/22

[52] U.S. Cl. ..... 373/153; 373/154

[58] Field of Search ..... 373/151–154

[56] References Cited

U.S. PATENT DOCUMENTS 5,247,539 9/1993 Gillhaus ..... 373/153

5,430,758 7/1995 Gillhaus ..... 373/153

*Primary Examiner*—Tu B. Hoang

*Attorney, Agent, or Firm*—Herbert L. Lerner; Laurence A. Greenberg

[57] ABSTRACT

A magnetic yoke for an induction crucible furnace includes a bar-shaped core stack for conducting magnetic flux generated by a furnace coil of the furnace. The core stack is formed of a multiplicity of individual, mutually electrically insulated single laminations with edges. The core stack has a first principal surface facing the furnace coil and three second principal surfaces not facing the furnace coil. The first principal surface has a shape being subdivided threefold, defining a central region of the core stack to be positioned very near the furnace coil and two lateral regions of the core stack adjacent the central region, and defining a distance between the edges of the single laminations of the core stack and the furnace coil being increased towards the edge in the two lateral regions of the core stack, forming acute-angled, lamination-free sectors parallel to the furnace axis in two peripheral regions of the magnetic yoke being directed towards the furnace coil. An insulating body is formed of an electrically insulating and vibration-damping material. A carrier body has a U-shaped or C-shaped cross section and lateral walls at which the insulating body is mounted. The carrier body encloses the second three principal surfaces. The insulating body extends surface-wide from one to another of the lateral walls of the carrier body. Both the lateral walls of the carrier body and the core stack press the magnetic yoke surface-wide through the insulating body against the furnace coil.

14 Claims, 1 Drawing Sheet

MAGNETIC YOKE HAVING CARRIER BODY AND INSULATING BODY

BACKGROUND OF THE INVENTION

FIELD OF THE INVENTION

The invention relates to a magnetic yoke for an induction crucible furnace having a bar-like core stack being suitable for conducting magnetic flux generated by a furnace coil of the induction crucible furnace and being formed of a multiplicity of individual, mutually electrically insulated single laminations, the core stack having, at a principal surface facing the furnace coil, a shape being subdivided threefold for positioning a central region of the core stack very near the furnace coil, while a distance between edges of the single laminations of the core stack and the furnace coil increases towards the edge in two lateral regions of the core stack adjacent the central region, forming acute-angled, lamination-free sectors parallel to a furnace axis in two peripheral regions of the yoke being directed towards the furnace coil, the core stack being enclosed, on three principal surfaces not facing the furnace coil, by a carrier body being C-shaped or U-shaped in cross section, and each lateral wall of the carrier body mounting an insulating body formed of an electrically insulating and vibration-damping material.

Such a magnetic yoke having a carrier body and an insulating body is disclosed in German Published, Non-Prosecuted Application DE 42 10 374 A1, corresponding to allowed U.S. application Ser. No. 08/040,127, filed Mar. 30, 1993. As a consequence of the acute-angled, lamination-free sectors parallel to the furnace axis in the two peripheral regions of the yoke which are directed towards the furnace coil, a local induction of high specific power is prevented in the peripheral regions of the magnetic yoke and the temperature distribution inside the yoke is made uniform. The magnetic yoke is pressed against the furnace coil by the lateral walls of the carrier body and the insulating bodies.

With regard to the technology of inductive melting, reference is made to German Published, Non-Prosecuted Application DE 41 15 278 A1, corresponding to U.S. Pat. No. 5,247,539; and to German Published, Non-Prosecuted Application DE 42 10 374 A1, corresponding to allowed U.S. application Ser. No. 08/040,127, filed Mar. 30, 1993 now U.S. Pat. No. 5,430,758.

SUMMARY OF THE INVENTION

It is accordingly an object of the invention to provide a magnetic yoke having a carrier body and an insulating body, which overcomes the hereinafore-mentioned disadvantages of the heretofore-known devices of this general type and which ensures a high damping of the vibrations produced during the operation of the induction crucible furnace.

With the foregoing and other objects in view there is provided, in accordance with the invention, in an induction crucible furnace having a furnace coil with a furnace axis, a magnetic yoke, comprising a bar-shaped core stack for conducting magnetic flux generated by the furnace coil, the core stack being formed of a multiplicity of individual, mutually electrically insulated single laminations with edges, the core stack having a principal surface facing the furnace coil and three principal surfaces not facing the furnace coil, the principal surface facing the furnace coil having a shape being subdivided threefold, defining a central region of the core stack to be positioned very near the furnace coil and two lateral regions of the core stack adjacent the central region, and defining a distance between the edges of the single laminations of the core stack and the furnace coil being increased towards the edge in the two lateral regions of the core stack, forming acute-angled, lamination-free sectors parallel to the furnace axis in two peripheral regions of the magnetic yoke being directed towards the furnace coil; an insulating body formed of an electrically insulating and vibration-damping material; a carrier body having a U-shaped or C-shaped cross section and lateral walls at which the insulating body is mounted, the carrier body enclosing the three principal surfaces of the core stack not facing the furnace coil; and the insulating body extending surface-wide from one to another of the lateral walls of the carrier body, and both the lateral walls of the carrier body and the core stack pressing the magnetic yoke surface-wide through the insulating body against the furnace coil.

The advantages which can be achieved with the invention are, in particular, that the transmission of the vibrations which originate from the furnace coil and are transferred to the furnace body at least partly through the magnetic yokes is very considerably damped since the magnetic yokes are pressed through insulating bodies formed of a vibration-damping material against the furnace coil in a surface-wide manner, both by the core stacks and by the lateral walls of the carrier bodies. The special shape of the insulating bodies ensures the surface-wide pressing despite the lamination-free, acute-angled sectors in the peripheral regions of the yoke. In addition to the reduction in noise, the surface-wide pressing of the yoke through an insulating body has the further advantageous effect of ensuring that no metallic part can come into contact with the current-carrying furnace coil in the event of failure of the coil insulation and consequently cause a short circuit. Furthermore, no dirt or metallic dusts, which would possibly result in a flash-over at that point, can come between the core stack and the furnace coil either.

In accordance with another feature of the invention, the insulating body is constructed as a single piece.

In accordance with a further feature of the invention, the insulating body has three pieces including two insulating blocks being mounted on the lateral walls of the carrier body and an insulating surface being disposed between the two insulating blocks.

In accordance with an added feature of the invention, the carrier body has a rear wall being subdivided threefold defining a central part and two lateral parts, the lateral parts being inclined surfaces with an increasing distance from the furnace coil, and the lateral parts of the rear wall and the lateral walls of the carrier body enclosing an acute angle therebetween. In accordance with an additional feature of the invention, the acute angle is 45°.

In accordance with yet another feature of the invention, the carrier body is formed of a material with good electrical conduction. In accordance with yet a further feature of the invention, the carrier body is formed of aluminum or an aluminum alloy.

In accordance with yet an added feature of the invention, the carrier body is constructed as a single piece.

In accordance with yet an additional feature of the invention, the carrier body includes at least one extruded part.

In accordance with again another feature of the invention, the carrier body is resistant to bending and warping.

In accordance with again an further feature of the invention, the carrier body has at least one longitudinal channel formed therein for conducting a coolant.

In accordance with a concomitant feature of the invention, relating to vibration damping, the at least one longitudinal channel or cavities in the carrier body not serving as cooling channels are filled with a strongly vibration-damping material and are preferably filled up with a casting compound.

Other features which are considered as characteristic for the invention are set forth in the appended claims.

Although the invention is illustrated and described herein as embodied in a magnetic yoke having a carrier body and an insulating body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
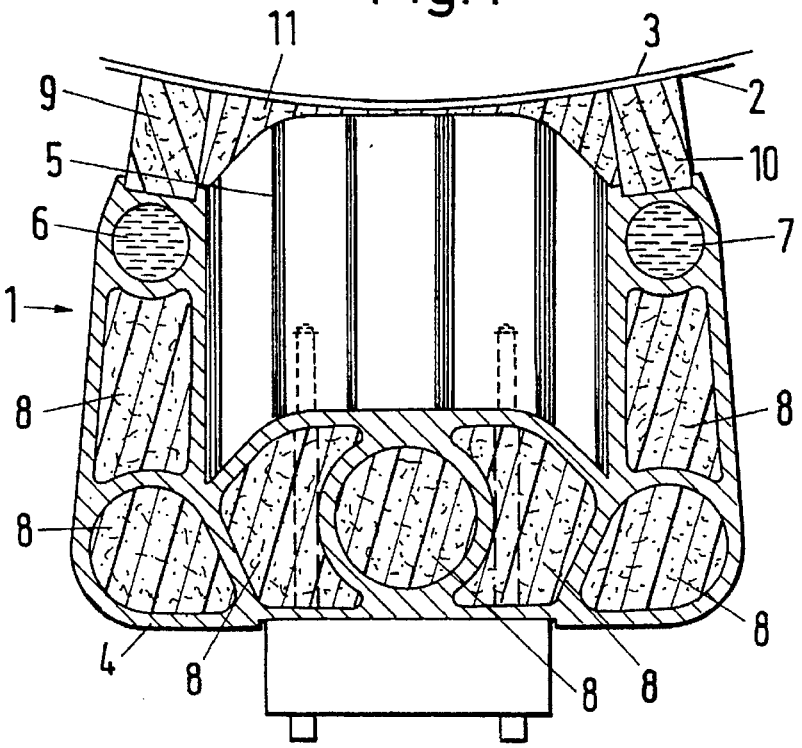
FIG. 1 is a diagrammatic, sectional view of a magnetic yoke having an insulating body including three component parts.

Referring now to the figures of the drawing in detail and first, particularly, to FIG. 1 thereof, there is seen a section through a magnetic yoke having an insulating body including three component parts. It can be seen that an active core stack 5 is enclosed by a single-piece carrier body 4 in a C-shaped or U-shaped manner (including a rear wall with two lateral walls). The carrier body 4 is expediently formed as an extruded part, and specifically, it is preferably formed from an aluminum alloy, which has the advantage of high electrical conductivity. The core stack 5 includes a multiplicity of individual, mutually electrically insulated single laminations and has acute-angled sectors in two peripheral regions, in which the single laminations of the core stack have an increasing distance from a furnace coil 3. Expediently, the width of the lateral walls of the carrier body 4 is equal to the width of a single lamination, with the result that the sectors are also not restricted by the carrier body.

The carrier body 4 has a plurality of individual longitudinal channels 6, 7, 8, with the result that, in cross section, the extruded part is a latticework having a large number of longitudinal cavities. This ensures a high resistance to bending and torsion accompanied by comparatively low material usage, low material weight and low material costs. In order to damp radial vibrations which are transmitted from the furnace coil 3 with coil insulation 2 to the furnace body through magnetic yokes 1 and a frame, the individual longitudinal channels 8 are filled with a strongly vibration-damping material, for example a casting compound (casting resin mixed with fibers). The further longitudinal channels 6, 7 may be used as internal cooling channels for circulating a coolant, which provides a high heat dissipation capability for magnetic field heat losses produced in the core stacks during operation, as a consequence of the large heat-transmission areas.

Depending on the heat-transmission area that is necessary, one, two, three or more longitudinal channels can be used as coolant channels. This ensures that the temperature of the core stacks and of the carrier body is kept within permissible limits. Service water, for example, may be used as the coolant. The use of separate cooling devices which have to be brought into direct heat-conduction contact with the core stacks or with the carrier body is not necessary.

The pressing of the magnetic yoke 1 against the furnace coil 3 which is brought about by the frame of the furnace body takes place due to both the active core stack 5 and by the carrier body 4. At end surfaces of the lateral walls of the carrier body 4, insulating blocks 9, 10 engage in corresponding grooves at the end surfaces and are pressed against the furnace coil 3. The core stack 5 presses against the furnace coil 3 or the coil insulation 2 with an insulating surface 11 extending from the insulating block 9 to the insulating block 10. Both the insulating blocks 9, 10 and the insulating surface 11 are composed of an electrically insulating material having strongly vibration-damping properties. In order to prevent crack formation, the material (for example casting compound) may be provided with fibers. As can be seen in FIG. 1, both the two insulating blocks 9, 10 and the insulating surface 11 match the shape of the furnace coil, thereby ensuring a gap-free pressing of the yoke against the furnace coil 3.

As can be seen in FIG. 1, that part of the rear wall of the carrier body 4 which comes into contact with the core stack 5 has a straight central part that is adjoined by two lateral parts each being formed as inclined surfaces having an increasing distance from the furnace coil 3. Consequently, an acute angle, of preferably 45°, is formed between the lateral parts of the rear wall and the lateral walls of the carrier body 4. The central part of the rear wall of the carrier body may also be formed cylindrically in accordance with the shape of the furnace coil. This special shape of the rear wall of the carrier body, which shape is subdivided in a threefold manner, simplifies and lessens the cost of production of the magnetic yoke since the single laminations of the core stack can each be of the same width. The optimization of the magnetic flux which is explained in detail in German Published, Non-Prosecuted Application DE 42 10 374 A1, corresponding to allowed U.S. application Ser. No. 08/040, 127, filed Mar. 30, 1993, is achieved at the same time. The angling of the core stack near the lateral walls of the carrier body results in a relatively large exit area for the magnetic flux of the transverse field, which avoids locally excessive heating in the core stack and the carrier body as a consequence of high flux concentration. The screening action of the carrier body 4, which is composed of electrically conductive material, prevents the flux in the screened region from entering or leaving transversely to the longitudinal axis of the core stack 5, with the result that corresponding additional losses are avoided.

Since the insulating surface 11 extends not only over the straight central part of the core stack, but also over the lateral parts which form inclined surfaces, it is ensured that the core stack presses against the furnace coil over its entire width.

Figure 2:
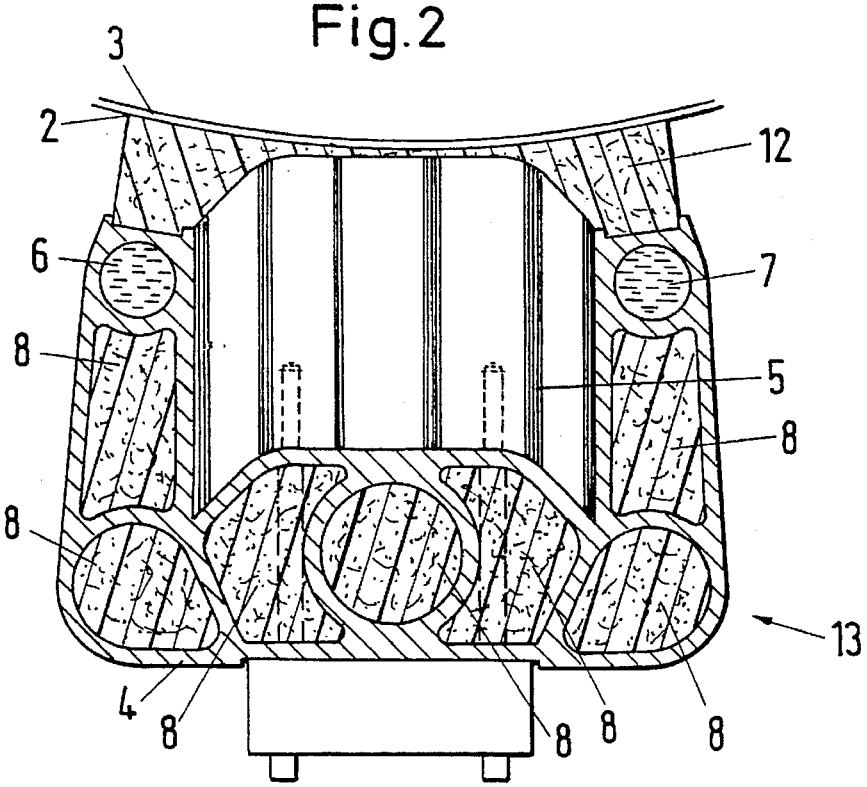
FIG. 2 is a sectional view of a magnetic yoke having a single-piece insulating body.

FIG. 2 shows a section through a magnetic yoke having a single-piece insulating body. A magnetic yoke 13 again includes the carrier body 4, the core stack 5 and longitudinal channels 6, 7 and 8 being provided in the carrier body 4. The longitudinal channels serve to conduct a coolant or are filled with a strongly vibration-damping material. However, as a departure from the insulating body of the embodiment shown in FIG. 1, wherein the insulating body includes three component parts, the insulating body of FIG. 2 is formed as a single piece and includes a single insulating block 12 which engages in corresponding grooves in the end surfaces of the lateral walls of the carrier body 4 and extends both over the end surfaces and over the core stack. The yoke 13 is pressed against the furnace coil 3 with the coil insulation 2 in a surface-wide manner as is also the case in the embodiment shown in FIG. 1.

We claim:

1. In an induction crucible furnace having a furnace coil with furnace axis, a magnetic yoke, comprising:

a bar-shaped core stack for conducting magnetic flux generated by the furnace coil, said core stack being formed of a multiplicity of individual, mutually electrically insulated single laminations with edges, said core stack having a principal surface facing the furnace coil and three principal surfaces not facing the furnace coil, said principal surface facing the furnace coil having a shape being subdivided threefold, defining a central region of said core stack to be positioned very near the furnace coil and two lateral regions of said core stack adjacent said central region, and defining a distance between said edges of said single laminations of said core stack and the furnace coil to be increased towards said edge in said two lateral regions of said core stack, forming acute-angled, lamination-free sectors parallel to the furnace axis in two peripheral regions of the magnetic yoke and to be directed towards the furnace coil;

an insulating body formed of an electrically insulating and vibration-damping material;

a carrier body having lateral walls at which said insulating body is mounted, said carrier body enclosing said three principal surfaces of said core stack not facing the furnace coil; and said insulating body extending surface-wide from one to another of said lateral walls of said carrier body, and said lateral walls of said carrier body and said core stack pressing the magnetic yoke surface-wide through said insulating body against the furnace coil.

2. The yoke according to claim 1, wherein said carrier body has a U-shaped cross section.

3. The yoke according to claim 1, wherein said carrier body has a C-shaped cross section.

4. The yoke according to claim 1, wherein said insulating body is constructed as a single piece.

5. The yoke according to claim 1, wherein said insulating body has three pieces including two insulating blocks being mounted on said lateral walls of said carrier body and an insulating surface being disposed between said two insulating blocks.

6. The yoke according to claim 1, wherein said carrier body has at least one longitudinal channel formed therein being filled with a vibration-damping material.

7. The yoke according to claim 1, wherein said carrier body has at least one longitudinal channel formed therein for conducting a coolant.

8. The yoke according to claim 1, wherein said carrier body has a rear wall being subdivided threefold defining a central part and two lateral parts, said lateral parts being inclined surfaces with an increasing distance from the furnace coil, and said lateral parts of said rear wall and said lateral walls of said carrier body enclosing an acute angle therebetween.

9. The yoke according to claim 8, wherein said acute angle is 45°.

10. The yoke according to claim 1, wherein said carrier body is formed of a material with good electrical conduction.

11. The yoke according to claim 10, wherein said carrier body is formed of a material selected from the group consisting of aluminum and an aluminum alloy.

12. The yoke according to claim 1, wherein said carrier body is constructed as a single piece.

13. The yoke according to claim 1, wherein said carrier body includes at least one extruded part.

14. The yoke according to claim 1, wherein said carrier body is resistant to bending and warping.

* * * * *